US007816598B2

(12) United States Patent
Ishihara et al.

(10) Patent No.: US 7,816,598 B2
(45) Date of Patent: Oct. 19, 2010

(54) ELECTRONIC KEYBOARD MUSICAL INSTRUMENT HAVING KEY ACTUATORS

(75) Inventors: Hideki Ishihara, Hamamatsu (JP); Motohide Shimizu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 186 days.

(21) Appl. No.: 11/968,625

(22) Filed: Jan. 2, 2008

(65) Prior Publication Data

US 2008/0163741 A1 Jul. 10, 2008

(30) Foreign Application Priority Data

Jan. 5, 2007 (JP) ..... 2007-000661
Jul. 5, 2007 (JP) ..... 2007-177120

(51) Int. Cl.
*G10D 9/00* (2006.01)

(52) U.S. Cl. ..... 84/423 R

(58) Field of Classification Search ..... 84/423 R, 84/424, 425, 430–437
See application file for complete search history.

(56) References Cited

U.S. PATENT DOCUMENTS 5,861,566 A 1/1999 Kaneko et al.
6,002,078 A * 12/1999 Yoshinaga et al. ..... 84/436
2006/0225563 A1 10/2006 Ohba

FOREIGN PATENT DOCUMENTS

| | | |
|---|---|---|
| CN | 1838227 A | 9/2006 |
| JP | 9-237082 | 9/1997 |
| JP | 2004-29549 | 1/2004 |
| JP | 2005-55541 | 3/2005 |
| JP | 2006-267448 A | 10/2006 |

OTHER PUBLICATIONS

Office Action mailed Nov. 13, 2009, for CN Application No. 200810000217.7, with English Translation, 10 pages.

* cited by examiner

*Primary Examiner*—Kimberly R Lockett
(74) *Attorney, Agent, or Firm*—Morrison & Foerster LLP

(57) ABSTRACT

An electronic keyboard musical instrument comprises a keyboard assembly including juxtaposed keys and juxtaposed swing weight mechanisms, each of the keys correspondingly linked with each of the swing weight mechanisms. Actuating members are provided corresponding to the respective swing weight mechanisms each of which in turn actuates each corresponding key. The actuating members are arranged in the vicinity of the fulcrum of the swing weight mechanisms and disposed in two rows as a front row and a rear row and extending downward through the key bed. The heights of the actuating members are made small. An actuator cover has a rearward descending slant wall so that the knees of the player will not be obstructed in depressing the pedals.

7 Claims, 6 Drawing Sheets

Keyboard Arrangement with Actuators

Actuator Unit

Keyboard Arrangement with Actuators

Actuator Unit

Musical Instrument Body (Side View)

Musical Instrument Body (Bottom View)

Plan View of Solenoid Array

Plan View of Solenoid Array (Prior Art)

Keyboard Arrangement with Actuators

ELECTRONIC KEYBOARD MUSICAL INSTRUMENT HAVING KEY ACTUATORS

TECHNICAL FIELD

The present invention relates to an electronic keyboard musical instrument in which musical notes are played back electronically in accordance with the music playing data signals and in addition the keys in the keyboard are physically actuated along with the music playing data signals.

BACKGROUND INFORMATION

Known in the art are player pianos or the like apparatuses. A player piano is an acoustic piano wherein the keys are actuated by a built-in or an externally attached actuator unit including solenoid plungers or the like in accordance with the recorded music playing data such as punched holes on a piano roll and MIDI data on a storage medium, the keys in turn actuating the corresponding piano action hammers to strike the corresponding piano strings, thereby conducting an automatic performance of piano music. An example of such an actuator unit is disclosed in the specification of U.S. Pat. No. 5,861,566 (corresponding to unexamined Japanese patent publication No. H9-237082).

Also known in the art are electronic musical instruments having electronic tone generators wherein the tone generators generate musical tones in accordance with music playing data to conduct an automatic music performance. The music playing data may preferably be of a MIDI format, and may be externally inputted (e.g. from a sequencer) or may be transferred from an external music work source via a communication network or via a storage medium to a music playing data processing circuit (sometimes further via an internal memory) so that the read-out music playing data control the tone generators to conduct an automatic music performance.

In the case of an electronic musical instrument, an automatic music performance can be conducted without actuating the keys in the keyboard, contrary to the case of an acoustic piano. Recently, however, there is a desire that the keys should move along with the tone generation by the tone generator circuits to visually enjoy the progressing automatic music performance in addition to aural enjoyment of the music. Electronic musical instruments having keys which move along with the progressing automatic music performance conducted by music performance data signals are disclosed, for example, in unexamined Japanese patent publication No. 2004-29549 and in unexamined Japanese patent publication No. 2005-55541.

In the first one of the above referenced publications, the solenoids for actuating the keys are provided near the rear end of the keys at the area away (as viewed from the player) from the swing fulcrum. In the acoustic piano, the swing fulcrum for the keys resides on the middle rail carrying balance pins, and accordingly a space for placing the solenoid units can be easily prepared in the area away from the middle rail.

In the electronic piano disclosed in the second one of the above referenced publications, a key arm is extended from the key rearward than the swing fulcrum (pivot) of the key, and the rear end of the extended key arm is actuated by the solenoid plunger. This necessitates the space beyond the key and the size of the instrument body will be increased accordingly, and the general merit of an electronic piano as being compact will be impaired.

In the electronic piano disclosed in the third one of the above referenced publications, a swing weight mechanism is provided underneath the key and a solenoid plunger actuates the swing weight mechanism from below. This structure solves the problem of the size increase. However, as the keyboard assembly of the electronic piano is placed on the key bed, the provision of such an actuator below the keyboard assembly will cause a substantial protrusion from the key bed.

Thickening the key bed or the similar case structure would avoid such protrusion of actuators, there will be a limit in thickening the instrument body around the keyboard, as the player of the instrument needs to push in the knees and the legs to manipulate the pedals in the case of an electronic piano. It is therefore required to minimize the vertical sizes of the actuators and to devise the body structure of the instrument below the keyboard. The third one of the above referenced publication does not teach the details of the actuators and the body structure of the instrument below the keyboard.

SUMMARY OF THE INVENTION

In view of the foregoing circumstances, therefore, it is a primary object of the present invention to provide an electronic keyboard musical instrument, such as an electronic piano, in which the keys are actuated based on music playing data, yet the actuator unit will not protrude downward from the key bed so much as to obstruct the player's leg movements.

According to the present invention, the object is accomplished by providing an electronic keyboard musical instrument comprising: a keyboard assembly including a plurality of juxtaposed keys and a plurality of juxtaposed inertia presenting mechanisms, each of the juxtaposed keys being swingably supported on a first swing fulcrum for assuming an undepressed position and a depressed position, and each of the inertia presenting mechanisms being swingably supported on a second swing fulcrum and swingably linked to each corresponding one of the keys; a key bed provided underneath the keyboard assembly for supporting the keyboard assembly, the key bed defining a front edge which is toward an instrument player and a rear edge which is away from the instrument player; an actuator assembly including an actuator unit having a plurality of actuating members, each of the actuating members being associated with each corresponding one of the inertia presenting mechanisms and arranged at a position which is nearer than the first swing fulcrum to the front edge of the key bed for actuating the corresponding inertia presenting mechanism to bring the associated key from the undepressed position to the depressed position, each of the actuating members being arranged in the vicinity of the second swing fulcrum in two rows as a front row and a rear row with the adjacent actuating members being disposed in the rows different from each other and extending through the key bed downward; and an actuator cover for covering the actuator assembly from underneath. As the actuating members are arranged in the vicinity of the swing fulcrum of the inertia presenting mechanisms, the heights of the actuating members (thus, the actuator unit) can be decreased, which in turn decreases the downward protrusion from the instrument body below the keyboard. Thus, the player can enjoy a free space in moving his/her legs for the pedal manipulation. The actuator assembly may preferably include an actuating circuit board for controlling the actuator unit. The actuating circuit board may preferably be fixed underneath the key bed in parallel to the actuator unit, the both being elongate in the direction of the key juxtaposition. This arrangement will help in suppressing the downward protrusion.

In an aspect of the present invention, the actuator cover may comprise a slant wall descending from its upper front toward its lower rear, so that the obstruction to the player will be suppressed accordingly.

In another aspect of the present invention, the actuating members disposed in the front row may be made to operate in a shorter stroke than the actuating members disposed in the rear row, and to extend through the key bed in an amount smaller than the actuating members disposed in the rear row, and the slant wall of the actuator cover may be extended rearward to cover the actuating members of the front row from below. This arrangement will also be helpful in suppressing the obstruction to the player.

According to the present invention, the object is further accomplished by providing an electronic keyboard musical instrument comprising: an instrument body; a pedal depressibly pivoted to the instrument body for controlling the instrument; a keyboard assembly including a plurality of juxtaposed keys and a plurality of juxtaposed inertia presenting mechanisms, each of the juxtaposed keys being swingably supported on a first swing fulcrum for assuming an undepressed position and a depressed position, and each of the inertia presenting mechanisms being swingably supported on a second swing fulcrum and swingably linked to each corresponding one of the keys; a key bed provided underneath the keyboard assembly for supporting the keyboard assembly, the key bed defining a front edge which is toward an instrument player and a rear edge which is away from the instrument player; an actuator assembly including an actuator unit having a plurality of actuating members, each of the actuating members being associated with each corresponding one of the inertia presenting mechanisms and arranged at a position which is nearer than the first swing fulcrum to the front edge of the key bed for actuating the corresponding inertia presenting mechanism to bring the associated key from the undepressed position to the depressed position, each of the actuating members being arranged in the vicinity of the second swing fulcrum; and an actuator cover for covering the actuator assembly from below, the actuator cover having a lowest part which locates within 170 mm in a horizontal dimension from the emerging point of the pedal. This arrangement ensures the freedom of the leg movement of the instrument player.

In a still further aspect of the present invention, the actuator cover may be made integral with the key bed on which the keyboard assembly is supported. This arrangement will eliminate the manufacturing step of putting the actuator cover on to the key bed.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

Figure 3:
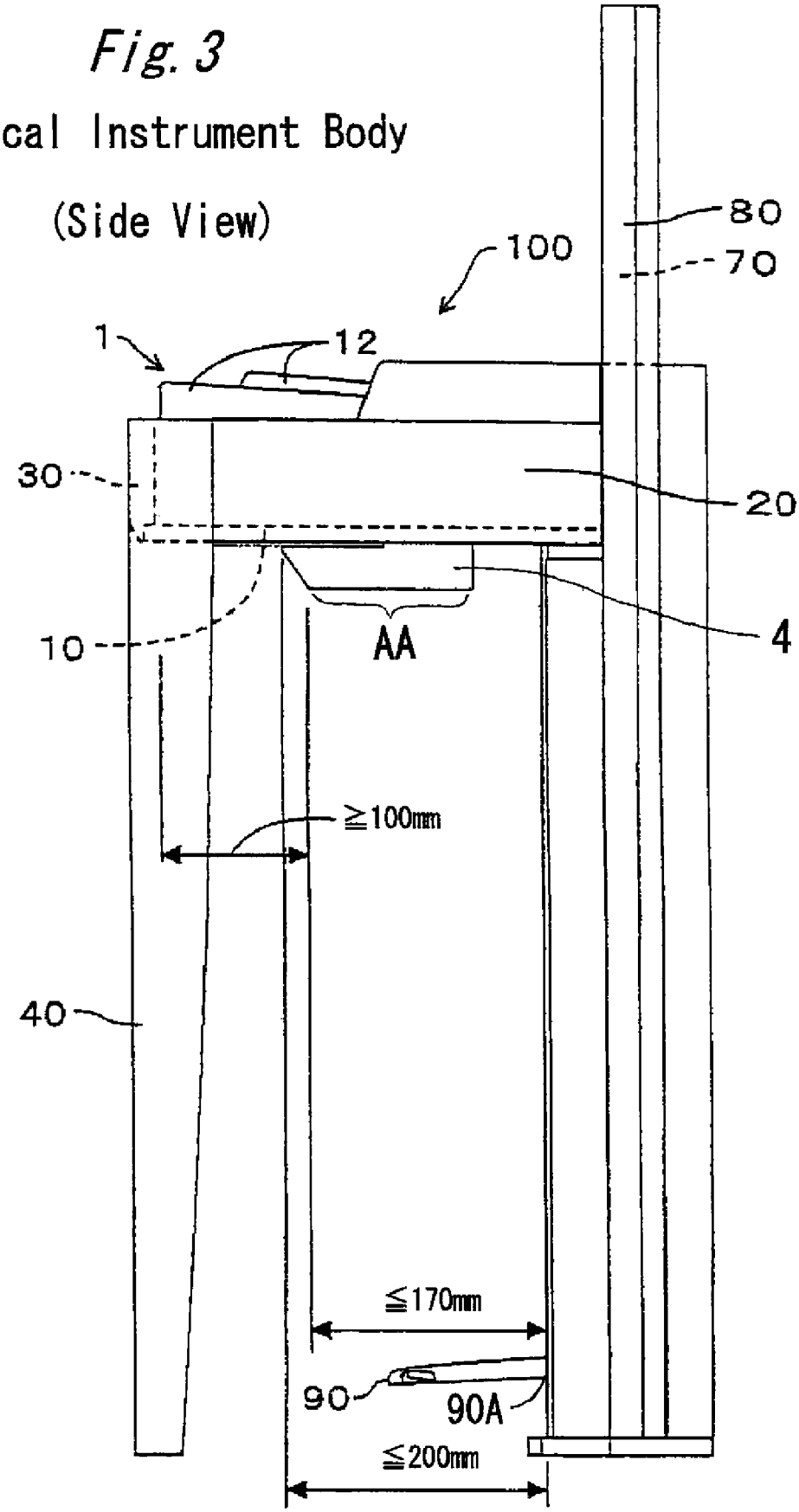
FIG. 3 is a side elevational view of an electronic keyboard musical instrument according to an embodiment of the present invention.
Figure 4:
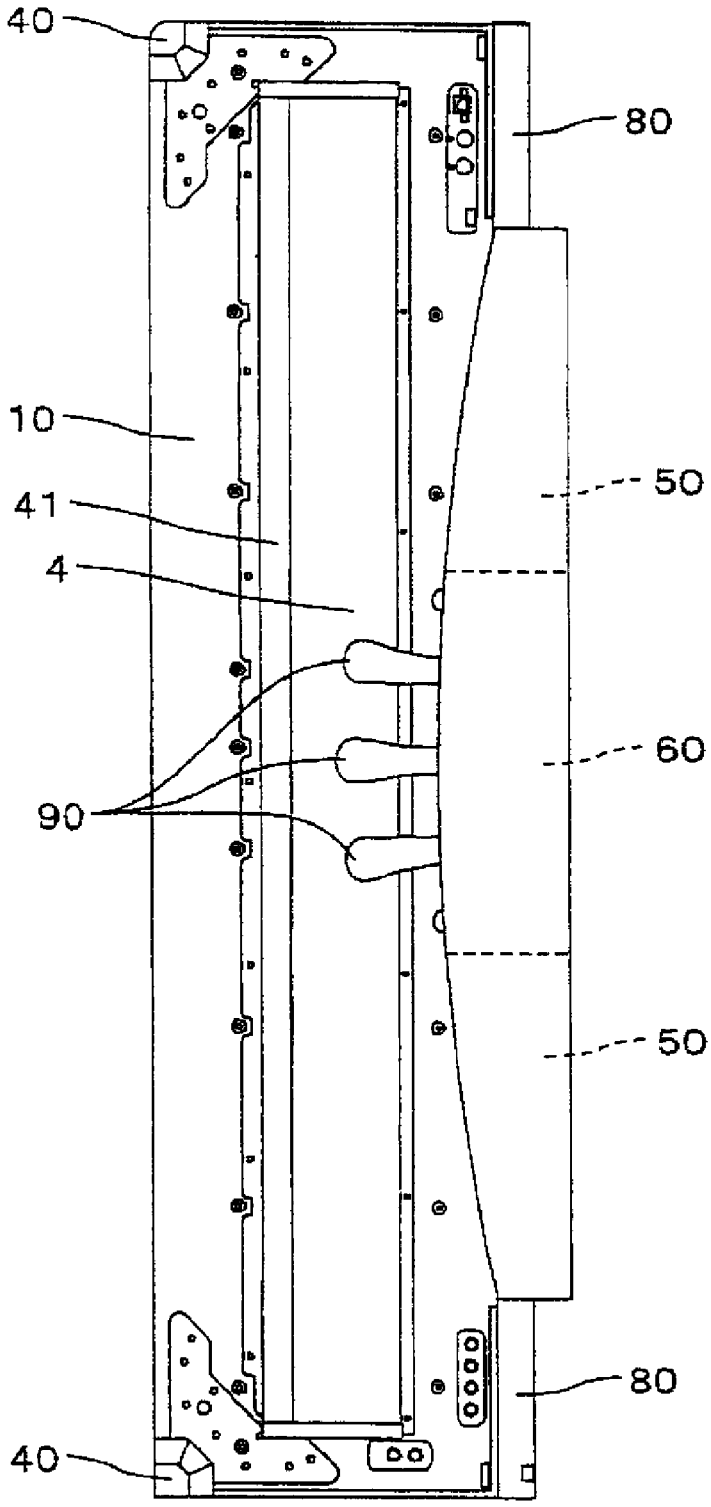
FIG. 4 is a bottom view of an electronic keyboard musical instrument according to an embodiment of the present invention.

Illustrated in FIGS. 3 and 4 is an electronic piano as an example of the electronic keyboard musical instrument embodying the present invention. A main instrument body 100 comprises a key bed 10 of a horizontal flat board on which is supported a keyboard assembly 1, and to which are attached side boards 20 at the right and left ends of the keyboard assembly 1 and a keyslip 30 at the front end of the keyboard assembly 1. At the front end of each of the side boards 20 is fixed a front leg 40 of the instrument to support the instrument body 100.

The rear part of the instrument body 100 includes right and left speaker boxes or enclosures 50, 50 (FIG. 4) which respectively carry right and left loudspeakers therein. A center box 60 is provided between the speaker boxes 50, 50 to carry a pedal mechanism and an electric power circuit, etc. The speaker boxes 50, 50 and the center box 60 constitute a rear leg of the instrument body 100. A central rear panel 70 is provided above the rear leg having approximately the same width as the rear leg at the rear part of the instrument body 100. Right and left side rear panels 80, 80 are also provided on the right and left sides of the speaker boxes 50, 50 and the central rear panel 70, having the same height as the top end of the central rear panel 70. Pedals 90 are projecting from the center box 60 toward the instrument player or user in the lower front area of the center box 60 to be depressed by the player.

Figure 1:
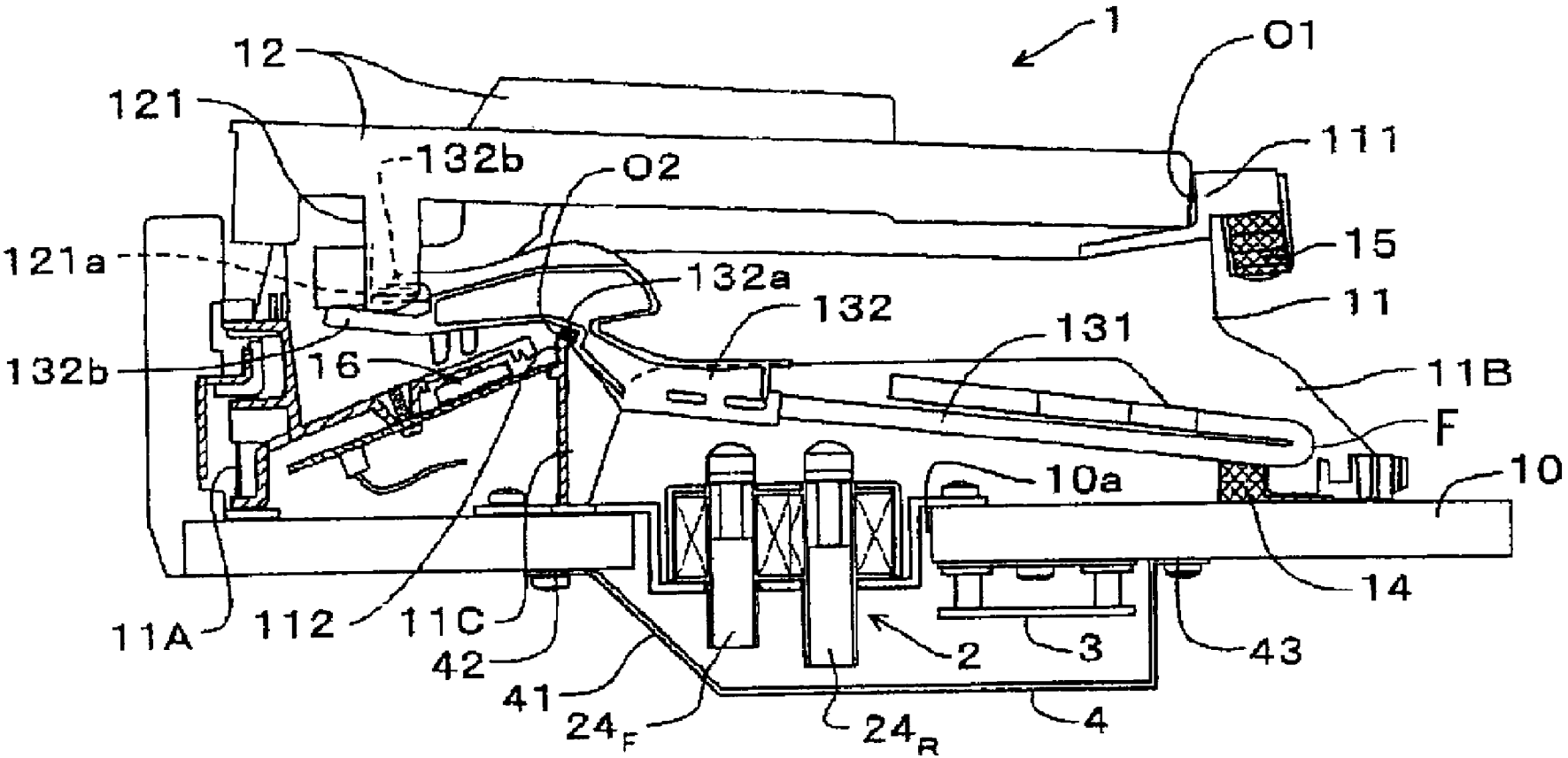
FIG. 1 is a cross-sectional side view of a keyboard arrangement having key actuators around the main portion of an electronic keyboard musical instrument according to an embodiment of the present invention.

The keyboard assembly 1 is mounted on the key bed 10 by means of a keyboard frame 11 as shown in FIG. 1. The keyboard assembly 1 includes a plurality of juxtaposed keys 12 coupled to a supporting rail 111 at the rear end of each of the keys 12. The keyboard frame 11 is fixed to the key bed 10 via front legs 11A, rear legs 11B and middle legs 11C. The keys 12 are arrayed side by side in juxtaposition in the left-to-right direction as seen from the player, and each of the keys is independently supported on the supporting rail 111 to swing up and down about a key swing fulcrum O1 on the rail 111 as the pivoting axis. The key 12 is provided with an actuating projection 121 extending downward from the key body.

Under each of the keys 12 is provided a swing weight mechanism or structure 13 as an inertia presenting mechanism for the movement of each key 12. The swing weight mechanism 13 comprises a bar weight 131 disposed in the front-to-rear direction and a seesaw piece 132 holding the front end of the bar weight 131. The seesaw piece 132 has a downward recess 132*a* which is swingably supported on the top edge of a supporting plate 112 which is formed in the keyboard frame 11 so that the swing weight mechanism 13 can swing up and down about a weight swing fulcrum O2 as the pivoting axis. The front end of the seesaw piece 132 has a connecting fork 132*b* formed with an upper and lower lugs. The actuating projection 121 of the key 12 has a connecting blade 121*a* formed at the lower end thereof to engage with the connecting fork 132*b*. As the key 12 is depressed, the actuating projection 121 presses down the seesaw piece 132 of the swing weight mechanism 13 so that the bar weight 131 rotates counterclockwise in the figure about the weight swing fulcrum O2 as the pivoting axis. When the key 12 is released, the bar weight 131 goes down as pulled by gravity to rotate clockwise in the figure to bring the linked key 12 back to the undepressed position. The key frame 11 is provided with stopper pieces 14, 15 made, for example, of felt at an upper inner limit and a lower inner limit of the keyboard frame 11 to limit the swing of the bar weight 131 of the swing weigh mechanism 13. In the front area of the keyboard frame 11, there are provided key switches 16 each of which is on/off actuated by the seesaw piece 132 of the swing weight mechanism 13 engaged with each corresponding key 12 in accordance with the depression/release of the key 12.

The key bed 10 is made of fiberboard (MDF, i.e. medium density fiberboard), and is provided with an aperture 10*a* below the joint portion of the bar weight 131 and the seesaw piece 132 of the swing weight mechanism 13. The aperture 10*a* is elongate approximately over the entire length of the juxtaposed keys 12 of the keyboard assembly 1 in the width direction (right/left direction) of the instrument body 100. In the aperture 10*a* is provided an actuator unit 2 including solenoid units 23 and plungers 24. There is further provided an actuating circuit board 3 on the undersurface of the key bed 10 in the rear of the actuator unit 2 for controlling the actuator unit 2.

Figure 2:
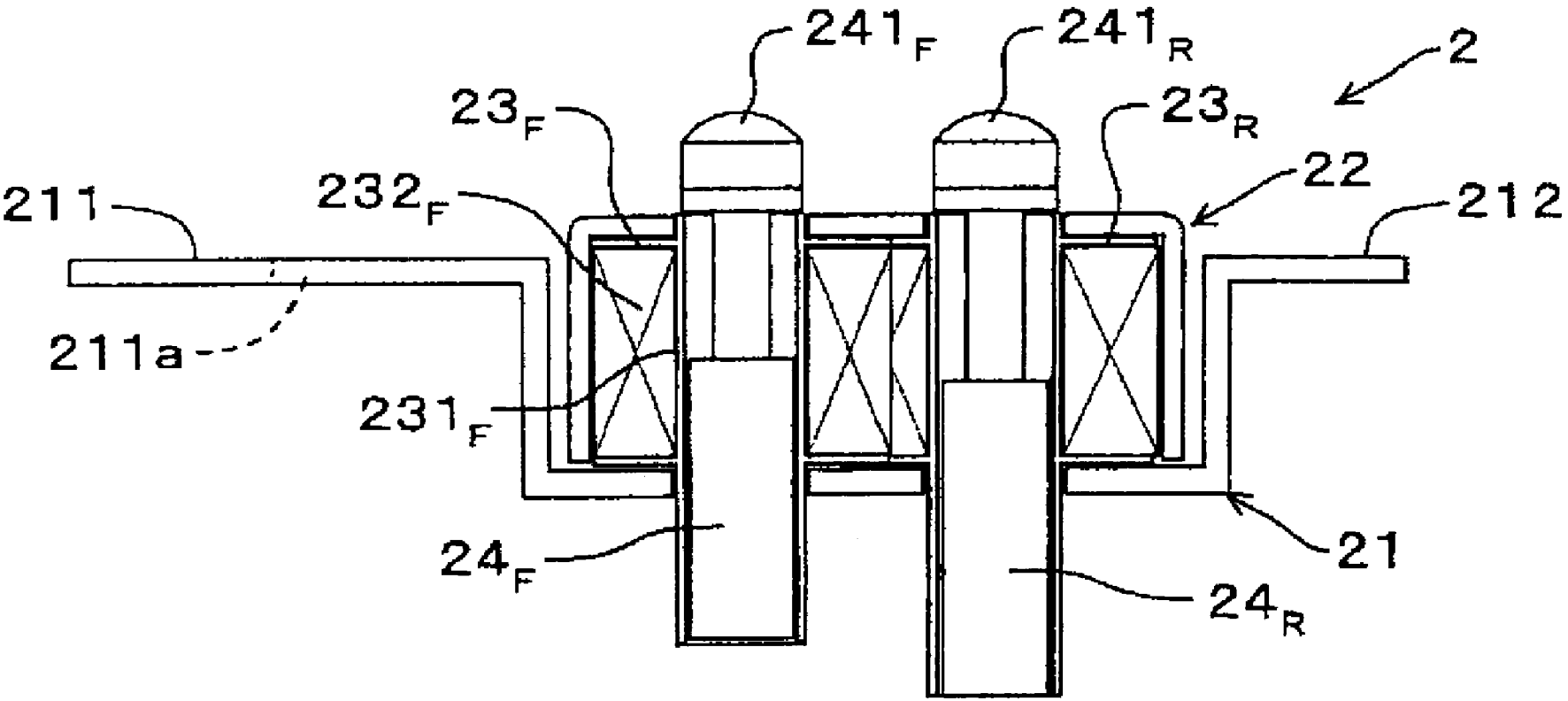
FIG. 2 is an enlarged cross-sectional side view of the part of FIG. 1 that shows the key actuators.

The actuator unit 2 comprises a lower yoke 21 of a U-channel shape and an upper yoke 22 of an inverted U-channel shape, both the yokes being elongate in the direction of the key juxtaposition. The upper yoke 22 is fitted in the lower yoke 21 to constitute an outer casing of the actuator unit 2, as shown in FIG. 2. The lower yoke 21 and the upper yoke 22 are made of a magnetic metal. The lower yoke 21 is formed with a front flange 211 and a rear flange 212 so that the actuator unit 2 is fixed to the key bed 10 by abutting the flanges 211, 212 on to the edges of the aperture 10*a* and screwing the flanges 211, 212 on to the key bed 10. The front flange 211 has a through hole 211*a* for accepting the lower end of the middle leg 11C of the keyboard frame 11, and a resilient shock absorbing material (not shown) is provided in the through hole 211*a*. The middle leg 11C bears the depressing forces against the keys 12 of the keyboard frame 1 and the resilient material suppresses mechanical noises transmitted from the middle leg 11C to the key bed 10.

The actuator unit 2 comprises solenoid units 23F, 23R and plungers 24F, 24R as actuating members. The suffix F denotes a member in the front row, while the suffix R denotes a member in the rear row. When the members are generally referred to without discriminating between the front and the rear, such suffixes will be omitted. The solenoid unit 23 comprises a bobbin 231 made of a non-magnetic material such as plastic and a coil 232 wound on the bobbin 23 between upper and lower flanges, and the plunger 24 is inserted through the bore of the center pipe of the bobbin 231, the center pipe extending outward than both the flanges to guide the plunger in sliding. On the top of the plunger 24 is provided a cushion 241 made of a resilient plastic material.

The actuator unit 2 and the actuating circuit board 3 constitute an actuator assembly, and an actuator cover 4 is attached under the key bed 10 to cover the actuator unit 2 and the actuating circuit board 3 as well as the aperture 10*a*. The actuator cover 4 has a slant wall 41 in its front side, forming a channel having a trapezoid cross section and being elongated in the direction of the key juxtaposition (width direction of the instrument body). The actuator cover 4 has flanges 42, 43 to screw the flanges 42, 43 on to the under surface of the key bed 10 to fix the actuator cover 4 to the key bed 10.

With the above construction, as electric power is supplied from the actuating circuit board 3 to the coil 232 of the solenoid unit 23, an induced magnetic flux passes through the lower yoke 21, the upper yoke 22 and the plunger 24, urging the plunger 24 to thrust upward further from the upper yoke 22. The plunger 24 pushes up via the cushion 241 the seesaw piece 132 or the bar weight 131 of the swing weight mechanism 13 so that the swing weight mechanism 13 rotates counterclockwise as viewed in FIG. 1, which in turn pulls down the key 12 to assume the depressed position of the key 12. More particularly, the front plunger 24F actuates the seesaw piece 132 and the rear plunger 24R actuates the bar weight 131. When the electric power supply to the coil 232 is cut off, the magnetic flux path disappears and the swing weight mechanism 13 rotates clockwise in FIG. 1 as pulled by gravity, which in turn pushes up the key 12 to assume the released or undepressed position of the key 12.

As shown in FIG. 1, the plungers 24F, 24R actuate the swing weight mechanisms 13 at the points which are nearer to the swing fulcrum O2 than the midpoint between the swing fulcrum O2 and the free end F of the bar weights 131. In order to rotate (or swing) the two adjacent swing weight mechanisms 13 by an equal amount of angles, the required stroke of the front plunger 24F may be smaller than the required stroke of the rear plunger 24R. The front plunger 24F and the center pipe of the front bobbin 231F are accordingly smaller in height than the rear plunger 24R and the rear bobbin 231R as shown in FIG. 2. For the same reason, as the plunger 24F, 24R are placed nearer to the swing fulcrum O2 of the swing weight mechanisms 13, the sizes and the strokes of the plungers 24F, 24R can be made smaller.

In other words, where the plungers 24F, 24R and the solenoid units 23F, 23R are disposed near to the swing fulcrum O2 of the swing weight mechanisms 13, the heights of the plungers 24F, 24R and of the bobbins 231F, 231R can be smaller accordingly, which in turn decreases the downward projection of the cover 4 from the key bed 10. This decreases obstructions to the player's operation of the pedals. Further, as the actuator cover 4 has a truncated portion formed by the slant wall 41 descending rearward and extending underneath the shortened front plungers 24F and front bobbins 231F, a free space for the player's knee movement can be increased.

Figure 5A:
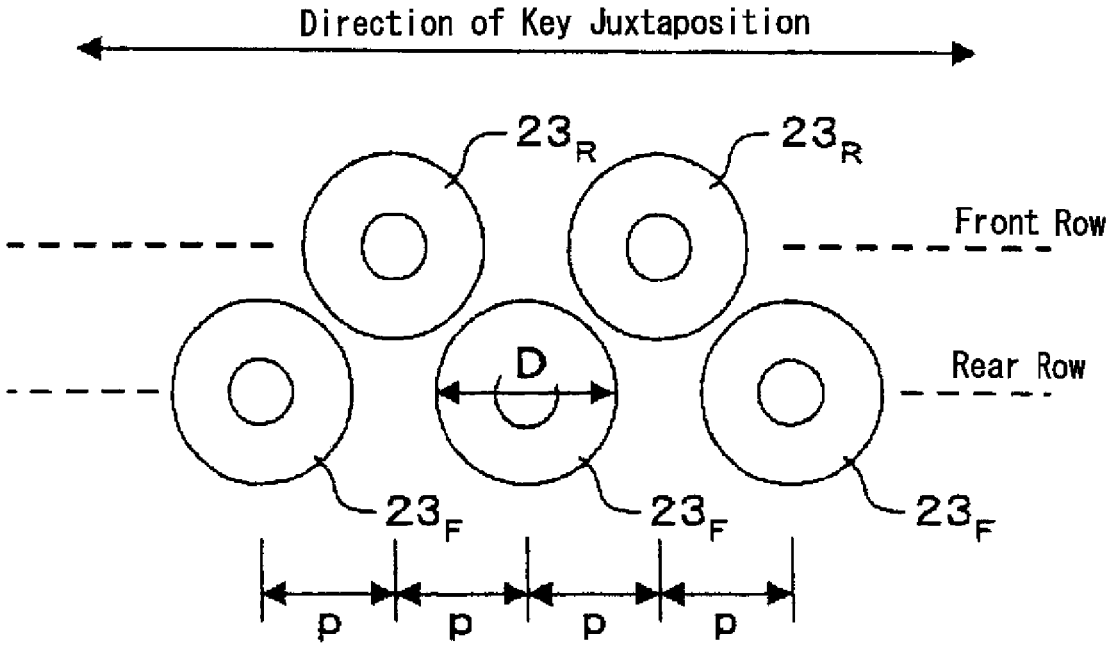
FIG. 5*a* is a plan view showing an array of solenoid plungers functioning as the key actuators in an electronic musical instrument according to an embodiment of the present invention.
Figure 5B:
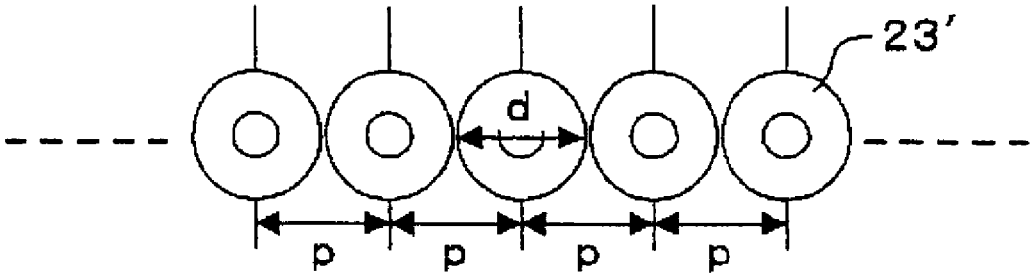
FIG. 5*b* is a plan view showing an example of an array of solenoid plungers functioning as the key actuators in an electronic musical instrument as employed in a prior art electronic musical instrument.

The solenoid units 23F in the front row and the solenoid units 23R in the rear row are arrayed correspondingly to the respective juxtaposed keys. As the front solenoids 23F and the rear solenoids 23R are alternately arrayed in the front row and the rear row so that every other solenoid 23 belongs to the front row and the remaining every other solenoid 23 belongs to the rear row. This means that the two adjacent solenoids belong to the different rows, and the diameter D of each solenoid 23F or 23R can be designed greater than the pitch p of the key juxtaposition as will be understood from FIG. 5*a*. On the contrary, if the solenoid unit 23' are arranged in a single row as shown in FIG. 5*b*, the diameter d of each solenoid can not be made greater than the key pitch p. As an alternative to the arrangement of FIG. 5*a*, the solenoid units 23 for the white keys may be arrayed in one row, for example in the front row, and the solenoid units 23 for the black keys may be arrayed in the other row, for example in the rear row. This arrangement will be advantageous in visually identifying which solenoid corresponds to which key, still giving the size increasing merit to almost the same degree as the above-mentioned arrangement of FIG. 5*a*.

The nearer to the swing fulcrum O2 of the swing weight mechanism 13 the plungers 24 would be located, the greater power would be necessary to drive the swing weight mechanism. As the alternately adjacent solenoids 23F, 23R are located in the different rows, the diameter D of each solenoid 23 can be made larger accordingly as described above, this ensures a larger actuating force by the plunger 24 and allow the plungers 24 to be located nearer to the weight swing fulcrum O2. Consequently, the amount of projection downward from the key bed 10 can be decreased or suppressed.

FIG. 3 illustrates detailed dimensions of the respective parts of the instrument main body. The actuator cover 4 for covering the actuator unit 2 is so designed that the lowest part (i.e. the bottom plate) AA of the cover 4 resides or locates within 170 mm in a horizontal dimension from the emerging points or pivoted ends 90A of the pedals 90 (defining the limit of the toe-reach of the instrument player) or more than 100 mm from the front ends of the keys 12 (defining the location of the thighs of the instrument player). This ensures unobstructed movements of the player's knees (i.e. legs) for operating the pedals 90 free from the actuator cover 4.

Although the aperture 10*a* in the key bed 10 is provided over almost the entire length of the key juxtaposition in the illustrated first embodiment, the rigidity or strength of the key bed 10 is maintained by the lower yoke 21 of the actuator unit 2 (and the actuator cover 4) connecting the front and rear edge areas of the aperture 10*a*. Further, as both the upper yoke 21 and the lower yokes 22 are formed in a U-channel shape, the moment of inertia of the section of the key bed as a whole is accordingly large to ensure the general robustness of the instrument body 100.

Figure 6:
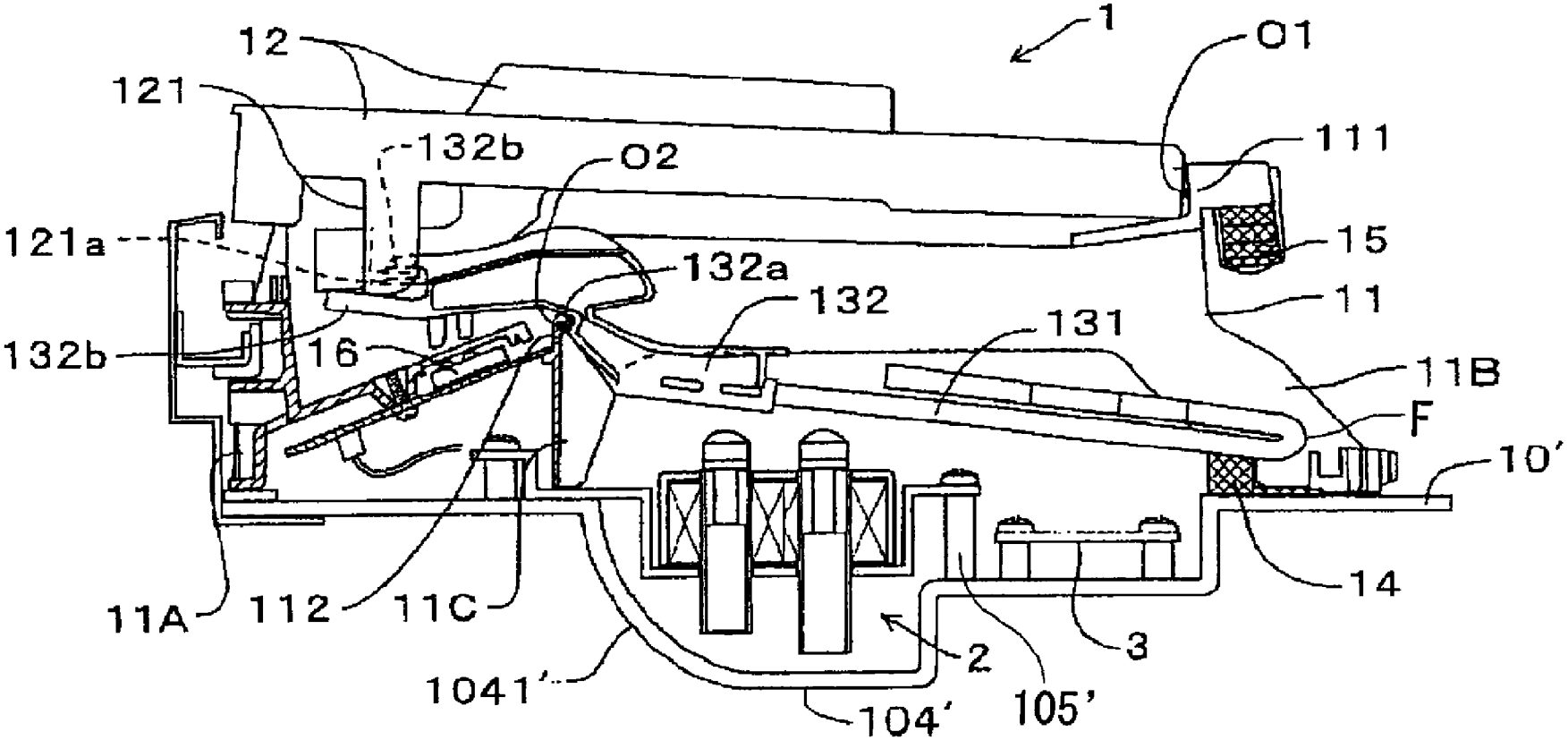
FIG. 6 is a cross-sectional side view of a keyboard arrangement having key actuators around the main portion of an electronic keyboard musical instrument according to another embodiment of the present invention.

FIG. 6 illustrates the main portion of the electronic keyboard musical instrument according to a second embodiment of the invention in a partly cross-sectioned side view, with like elements as in FIG. 1 being referenced with like numerals to avoid redundant description. This embodiment employs a key bed 10' integrally formed by a hard plastic or metal plate having sufficient stiffness or rigidity in place of the fiberboard key bed 10 of FIG. 1. An actuator cover portion 104' is integrally formed with the key bed portion 10' in place of the separate actuator cover 4 of FIG. 1. The actuator cover portion 104' has a slightly outward-curved slant wall 1041'. The actuator unit 2 and the actuating circuit board 3 are screwed on to the bosses formed on the inner surface of the actuator cover portion 104'. The second embodiment provides substantially same functions and merits.

While the elongate aperture 10*a* is formed in the key bed 10 in the first embodiment of FIG. 1, separate holes may be provided for the corresponding plungers 24, respectively. The actuator unit 2 can be then provided on the undersurface of the key bed 10.

Alternatively, the key bed 10, 10' may be manufactured by plastic molding, sheet metal bending, aluminum extrusion, or else.

The swing weight mechanism may be designed to return to its normal position by means of an urging spring in place of gravity.

Where the slant wall 41, 1041' of the actuator cover 4, 104' starts to descend at the front edge of the actuator cover 4, 104', the starting point of the descending may preferably be within a given range (e.g. less than 200 mm) from the emerging points 90A of the pedals 90.

While several preferred embodiments have been described and illustrated in detail herein above with reference to the drawings, it should be understood that the illustrated embodiments are just for preferable examples and that the present invention can be practiced with various modifications without departing from the spirit of the present invention.

What is claimed is:

1. An electronic keyboard musical instrument comprising:

a keyboard assembly including a plurality of juxtaposed keys and a plurality of juxtaposed inertia presenting mechanisms, each of the juxtaposed keys being swingably supported on a first swing fulcrum for assuming an undepressed position and a depressed position, and each of the inertia presenting mechanisms being swingably supported on a second swing fulcrum and swingably linked to each corresponding one of the keys;

a key bed provided underneath the keyboard assembly for supporting the keyboard assembly, the key bed defining a front edge which is toward an instrument player and a rear edge which is away from the instrument player;

an actuator assembly including an actuator unit having a plurality of actuating members, each of the actuating members being associated with each corresponding one of the inertia presenting mechanisms and arranged at a position which is nearer than the first swing fulcrum to the front edge of the key bed for actuating the corresponding inertia presenting mechanism to bring the associated key from the undepressed position to the depressed position, each of the actuating members being arranged in the vicinity of the second swing fulcrum in two rows as a front row and a rear row with the adjacent actuating members being disposed in the rows different from each other and extending through the key bed downward; and an actuator cover for covering the actuator assembly from underneath.

2. An electronic keyboard musical instrument as claimed in claim 1, wherein the actuator cover comprises a slant wall descending from its upper front toward its lower rear.

3. An electronic keyboard musical instrument as claimed in claim 2, wherein the actuating members disposed in the front row are made to operate in a shorter stroke than the actuating members disposed in the rear row, and to extend through the key bed in an amount smaller than the actuating members disposed in the rear row; and wherein the slant wall of the actuator cover is extended rearward to cover the actuating members of the front row from below.

4. An electronic keyboard musical instrument comprising:

an instrument body;

a pedal depressibly pivoted to the instrument body for controlling the instrument;

a keyboard assembly including a plurality of juxtaposed keys and a plurality of juxtaposed inertia presenting mechanisms, each of the juxtaposed keys being swingably supported on a first swing fulcrum for assuming an undepressed position and a depressed position, and each of the inertia presenting mechanisms being swingably supported on a second swing fulcrum and swingably linked to each corresponding one of the keys;

a key bed provided underneath the keyboard assembly for supporting the keyboard assembly, the key bed defining a front edge which is toward an instrument player and a rear edge which is away from the instrument player;

an actuator assembly including an actuator unit having a plurality of actuating members, each of the actuating members being associated with each corresponding one of the inertia presenting mechanisms and arranged at a position which is nearer than the first swing fulcrum to the front edge of the key bed for actuating the corresponding inertia presenting mechanism to bring the associated key from the undepressed position to the depressed position, each of the actuating members being arranged in the vicinity of the second swing fulcrum; and an actuator cover for covering the actuator assembly from below, the actuator cover having a lowest part which locates within 170 mm in a horizontal dimension from the emerging point of the pedal.

5. An electronic keyboard musical instrument as claimed in any one of claims 1-4, wherein the actuator cover is made integral with the key bed on which the keyboard assembly is supported.

6. An electronic keyboard musical instrument as claimed in claim 1, wherein the actuating members disposed in the front row are configured to operate in a shorter stroke than the actuating members disposed in the rear row and to extend through the key bed in an amount smaller than the actuating members disposed in the rear row; and wherein the actuator cover is extended rearward to cover the actuating members of the front row from below.

7. An electronic keyboard musical instrument as claimed in claim 4, wherein the actuating members are arranged in two rows as a front row and a rear row and each extending downward through the key bed, wherein each of the actuating members disposed in the front row is configured to operate in a shorter stroke than the actuating member disposed in the rear row and to extend through the key bed in an amount smaller than the actuating member disposed in the rear row; and wherein the actuator cover is extended rearward to cover the actuating members of the front row from below.

* * * * *